US010597257B2

(12) United States Patent
Duvall

(10) Patent No.: US 10,597,257 B2
(45) Date of Patent: Mar. 24, 2020

(54) HIGH SPEED BEARING ASSEMBLY FOR ELEVATOR SAFETY GEAR AND METHODS OF MAKING AND USING SAME

(71) Applicants: THYSSENKRUPP ELEVATOR AG, Essen (DE); THYSSENKRUPP AG, Essen (DE)

(72) Inventor: Jeffrey Duvall, Woodstock, GA (US)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 98 days.

(21) Appl. No.: 15/912,890

(22) Filed: Mar. 6, 2018

(65) Prior Publication Data

US 2018/0251339 A1 Sep. 6, 2018

Related U.S. Application Data

(63) Continuation-in-part of application No. 15/450,248, filed on Mar. 6, 2017, now Pat. No. 10,309,475.

(51) Int. Cl.

| | |
|---|---|
| ***B66B 5/22*** | (2006.01) |
| ***B66B 7/04*** | (2006.01) |
| ***B66B 7/02*** | (2006.01) |
| *B66B 5/04* | (2006.01) |

(52) U.S. Cl.

CPC ..... *B66B 5/22* (2013.01); *B66B 7/022* (2013.01); *B66B 7/046* (2013.01); *B66B 5/044* (2013.01)

(58) Field of Classification Search

CPC ..... B66B 5/22; B66B 7/022; B66B 7/046; B66B 5/044

See application file for complete search history.

(56) References Cited

U.S. PATENT DOCUMENTS

| | | | | |
|---|---|---|---|---|
| 3,762,512 A * | 10/1973 | McIntyre | B66B 5/22 188/189 |
| 4,819,765 A * | 4/1989 | Winkler | B66B 5/22 187/376 |
| 2002/0134624 A1* | 9/2002 | Sasaki | B66B 5/22 187/376 |

(Continued)

FOREIGN PATENT DOCUMENTS

| | | | |
|---|---|---|---|
| CN | 102219140 A | | 10/2011 |
| DE | 102015203440 | * | 2/2015 |

OTHER PUBLICATIONS

U.S. Appl. No. 15/450,248, Notice of Allowance dated Jan. 22, 2019.

(Continued)

*Primary Examiner* — Michael A Riegelman
(74) *Attorney, Agent, or Firm* — Lathrop GPM LLP

(57) ABSTRACT

Elevator braking systems. The elevator braking system comprises a wedge having a curved wedge bearing race and a clamping jaw having a curved jaw bearing race. The elevator braking system includes a roller bearing assembly. The assembly has two cages and a spacer maintains a space between the two cages. A plurality of rollers is rotatably coupled to the two cages. Each of the plurality of rollers is barrel shaped. A first side of the roller bearing assembly is configured to be coupled to the wedge via the curved wedge bearing race. A second side of the roller bearing assembly is configured to be coupled to the clamping jaw via the curved jaw bearing race.

13 Claims, 7 Drawing Sheets

(56) References Cited

U.S. PATENT DOCUMENTS

| | | | | |
|---|---|---|---|---|
| 2008/0296098 | A1* | 12/2008 | Sato | B66B 5/22 187/376 |
| 2017/0101292 | A1* | 4/2017 | Powers | B66B 5/044 |
| 2018/0252285 | A1* | 9/2018 | Duvall | F16D 69/0408 |
| 2019/0024716 | A1* | 1/2019 | Houdayer | F16C 33/467 |
| 2019/0107161 | A1* | 4/2019 | Drewes | F16D 51/20 |

OTHER PUBLICATIONS

Linear Flat Needle Roller Bearings, GOST designation (Minsk Bearing Plant designation): RIP 2025KK (FF 2025ZW) RIP 3020K (FF3020), http://www.mimprom.gov.by/eng/fair_products?page=0&ItemID=6725&SubSection_ID=1.03.03.

* cited by examiner

HIGH SPEED BEARING ASSEMBLY FOR ELEVATOR SAFETY GEAR AND METHODS OF MAKING AND USING SAME

CROSS REFERENCE TO RELATED APPLICATIONS

This application is a continuation-in-part of U.S. patent application Ser. No. 15/450,248 titled "Elevator Brake Pad Mounting Systems and Methods for Making and Using Same", filed Mar. 6, 2017, the disclosure of which is incorporated by reference herein in its entirety.

FIELD OF THE DISCLOSURE

The disclosure relates generally to the field of elevator safety gear. More specifically, the disclosure relates to bearing assemblies for use with elevator safety gear.

SUMMARY

The disclosure relates to elevator braking systems and to components thereof. In an embodiment, an elevator braking system comprises a wedge having a curved wedge bearing race and a clamping jaw having a curved jaw bearing race. The elevator braking system includes a roller bearing assembly. The assembly has two cages and a spacer maintains a space between the two cages. A plurality of rollers is rotatably coupled to the two cages. Each of the plurality of rollers is barrel shaped. A first side of the roller bearing assembly is configured to be coupled to the wedge via the curved wedge bearing race. A second side of the roller bearing assembly is configured to be coupled to the clamping jaw via the curved jaw bearing race.

In another embodiment, a roller bearing assembly configured to be movably coupled to a wedge of an elevator braking system has a first cage and a second cage. The assembly includes at least one spacer that maintains a space between the first cage and the second cage. The assembly comprises a plurality of rollers that are each rotatably coupled to the first cage and the second cage. Each of the plurality of rollers is barrel shaped. The assembly has a resetting spring which extends beneath the second cage.

In yet another embodiment, an elevator braking system comprises a wedge having a wedge bearing race and a clamping jaw having a jaw bearing race. The elevator braking system includes a roller bearing assembly. The assembly has two cages, and each of the two cages is a split cage. The two cages have at least one spacer extending therebetween. A plurality of rollers is rotatably coupled to the two cages. At least one of the plurality of rollers is barrel shaped.

BRIEF DESCRIPTION OF THE SEVERAL VIEWS OF THE DRAWINGS

Illustrative embodiments of the present disclosure are described in detail below with reference to the attached drawing figures and wherein.

DETAILED DESCRIPTION

A conventional elevator system includes one or more elevator cars which travel vertically along guiderails in an elevator hoistway. The elevator system often includes safety gear to manage elevator operation during abnormal conditions. The safety gear may include a braking mechanism that is activated, e.g., by an overspeed governor, when the elevator car travels at an excessive speed that is faster than a recommended maximum speed associated with the elevator car. The traveling of an elevator car at such excessive speeds may be attributable to one or more of several conditions. A fault of or failure in the elevator controller, for example, may cause the elevator car to travel faster than its recommend maximum speed. Or, for instance, the elevator may travel at an excessive speed where the elevator cable breaks, resulting in elevator free fall. In such situations, the safety braking mechanism is automatically activated to cause the elevator car to decelerate in a desired manner. The safety braking mechanism may cause the elevator car to decelerate by employing friction or brake pads that selectively interact with the elevator guiderail.

Figure 1:
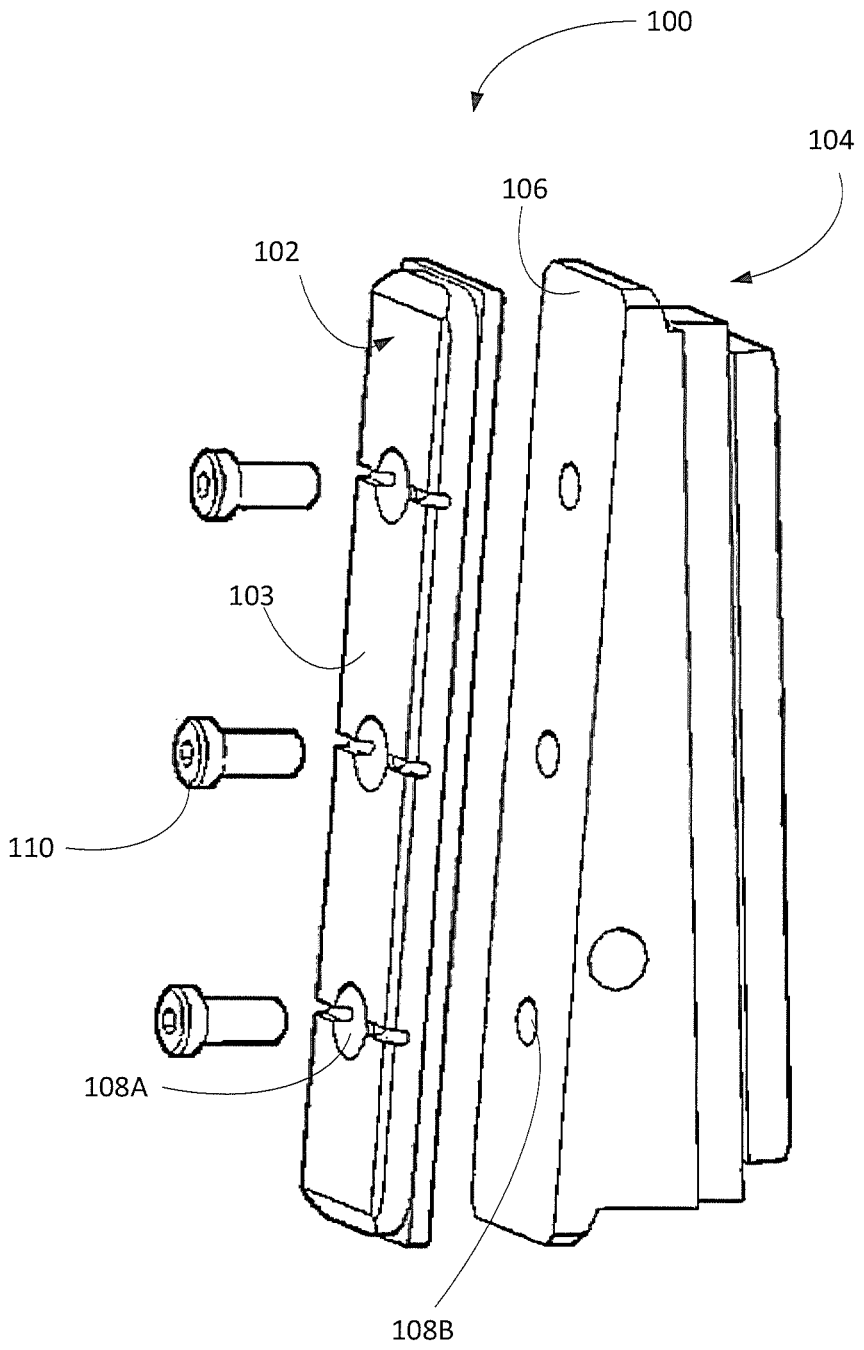
FIG. 1 (PRIOR ART)
FIG. 1 is a perspective view of a PRIOR ART elevator braking system.

FIG. 1 shows a typical safety braking system 100 for an elevator, as is known in the art. The prior art elevator braking system 100 includes a brake pad 102 having a braking face 103 and a wedge 104 having a wedge face 106. The brake pad 102 has apertures 108A, and the wedge 104 has apertures 108B that correspond to the apertures 108A. The brake pad 102 is attached to the wedge 104 via fasteners 110 that extend through the brake pad face 103 and the wedge face 106 (i.e., extend through the apertures 108A in the brake pad 102 and the apertures 108B in the wedge 104). Adhesive may also be provided between the back of the brake pad 102 and the wedge face 106. During the braking operation, one braking system 100 disposed at one side of the guiderail and another braking system 100 disposed at another side of the guiderail sandwich the guiderail such that the brake pads 102 forcefully contact the guiderail. The elevator decelerates due to the friction resulting from the interaction of the brake pads 102 with the guiderail.

Because failure of the brake pads 102 may result in injury and/or loss of life, it is of paramount importance that the brake pads 102 function as intended when called upon. However, finding suitable elevator brake pads, particularly for tall buildings (e.g., mid-rise buildings having fifteen to forty-nine floors or high rise buildings having fifty or more floors), is a difficult endeavor. The brake pads 102 experience high thermal shock, high mechanical impact loads, and high compressive and shear loads, all of which impact the life of the brake pad 102. Brake pad longevity is also adversely affected because of the suboptimal industry standard method for coupling the brake pad 102 to the wedge 104. Specifically, the apertures 108A that are included in the brake pad face 103 to allow the fasteners 110 to couple the brake pad 102 to the wedge 104 are weak spots that introduce undue stress in the pad 102, and consequently, render the pad 102 more prone to cracking and failure. Further, the apertures 108A that extend through the brake pad 102 undesirably reduce the surface area of the brake pad 102 that can contact the guiderail for the braking operation. Moreover, in many elevator braking systems, servicing or replacement of the brake pad 102 necessitates that the wedge 104 also be removed, e.g., from a clamp, which is inefficient. The present disclosure relates in part to a novel elevator braking system that may, among other things, allow for brake pads to be removed from the wedge while the wedge remains coupled to other associated components of the system. The disclosed system may further allow for use of brake pads that are devoid of apertures, as the brake pads may be operably coupled to the wedge without fasteners that extend through the brake pad surface.

The present disclosure also relates to a novel high-speed bearing assembly usable with elevator safety gear. During a braking operation, the wedges (together with the brake pads) move up to engage and clamp the guiderail. This clamping generates a retardation force that stops the elevator during an emergency. During braking, the wedges must be guided and must move freely with little drag. As the wedges move up, they compress a spring and this applies a clamping force to the guiderail. Typically, the spring compression action requires a pivoting mechanism (as with a pair of jaws that are pinned in the center, e.g., scissors). The wedges are at one end of the lever and the spring is at the other end. Low drag motion of the wedge is achieved in the prior art with the use of a linear roller bearing having cylindrical rollers.

Cylindrical rollers, such as those used in the prior art safety gear systems, however, are suboptimal. Specifically, the jaw pivoting motion may be problematic for the friction surface that touches the guiderail as this can cause uneven pressure on the face of the guiderail as well as the face of the friction surface. For high speed and high mass elevators, this friction interface becomes even more critical. If one region of the friction surface has more pressure, it causes hotspots, uneven wear of friction material, premature failure thereof, and results in generally unpredictable braking performance. The present disclosure addresses these concerns by using rollers that are barrel shaped (as opposed to being cylindrical) and races that are curved to allow the friction face to maintain even contact pressure on the guiderail.

Figure 2A:
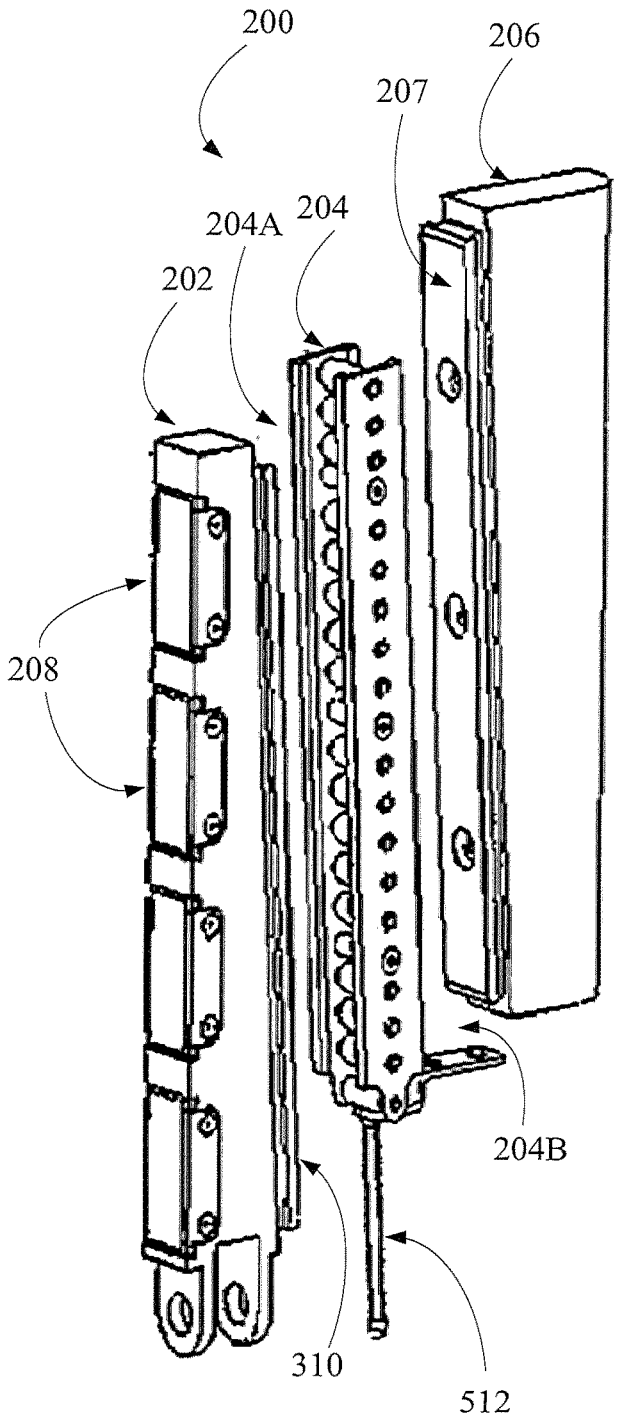
FIG. 2A is an exploded view of an elevator braking system, according to an example embodiment of the present disclosure.
Figure 2B:
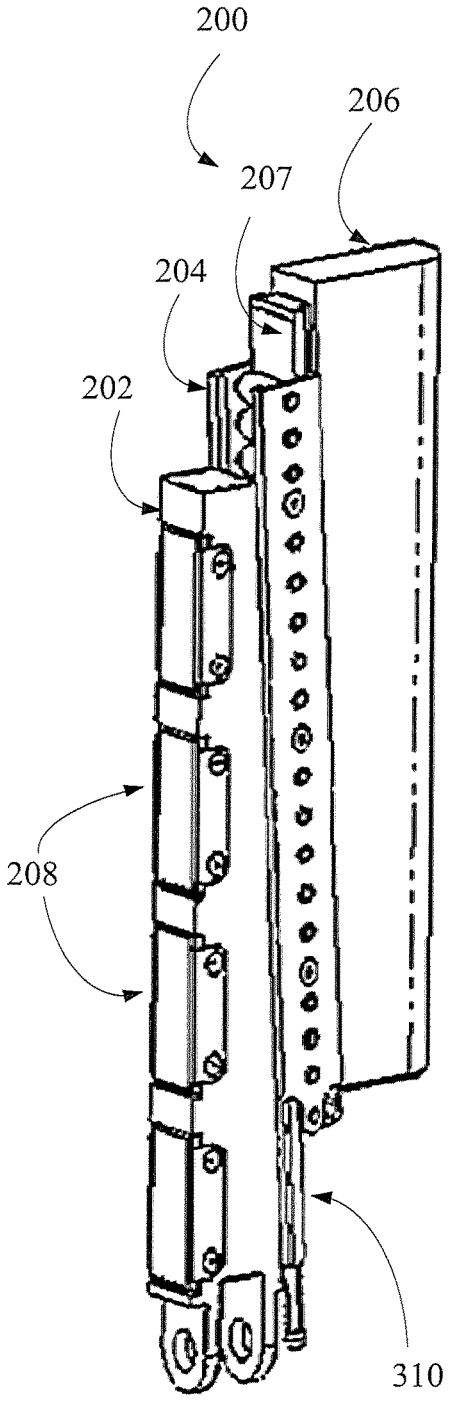
FIG. 2B is a perspective view of the elevator braking system of FIG. 2A.

Focus is directed now to FIGS. 2A and 2B, which illustrate an elevator braking system 200 according to an example embodiment. FIG. 2A shows an exploded view of the elevator braking system 200, and FIG. 2B shows the system 200 in an assembled configuration. The braking system 200, in an embodiment, may include a wedge 202, a roller bearing 204, and a clamping jaw 206. Each of the wedge 202, the roller bearing 204, and the clamping jaw 206 disclosed herein as part of the braking system 200 may include inventive aspects of the disclosure. Brake pads 208 may be operably secured to the wedge 202, as discussed herein. The artisan will understand that the braking operation may be effectuated by the collective interaction of the brake pads 208 of two braking systems 200 with the elevator guiderail.

Figure 3:
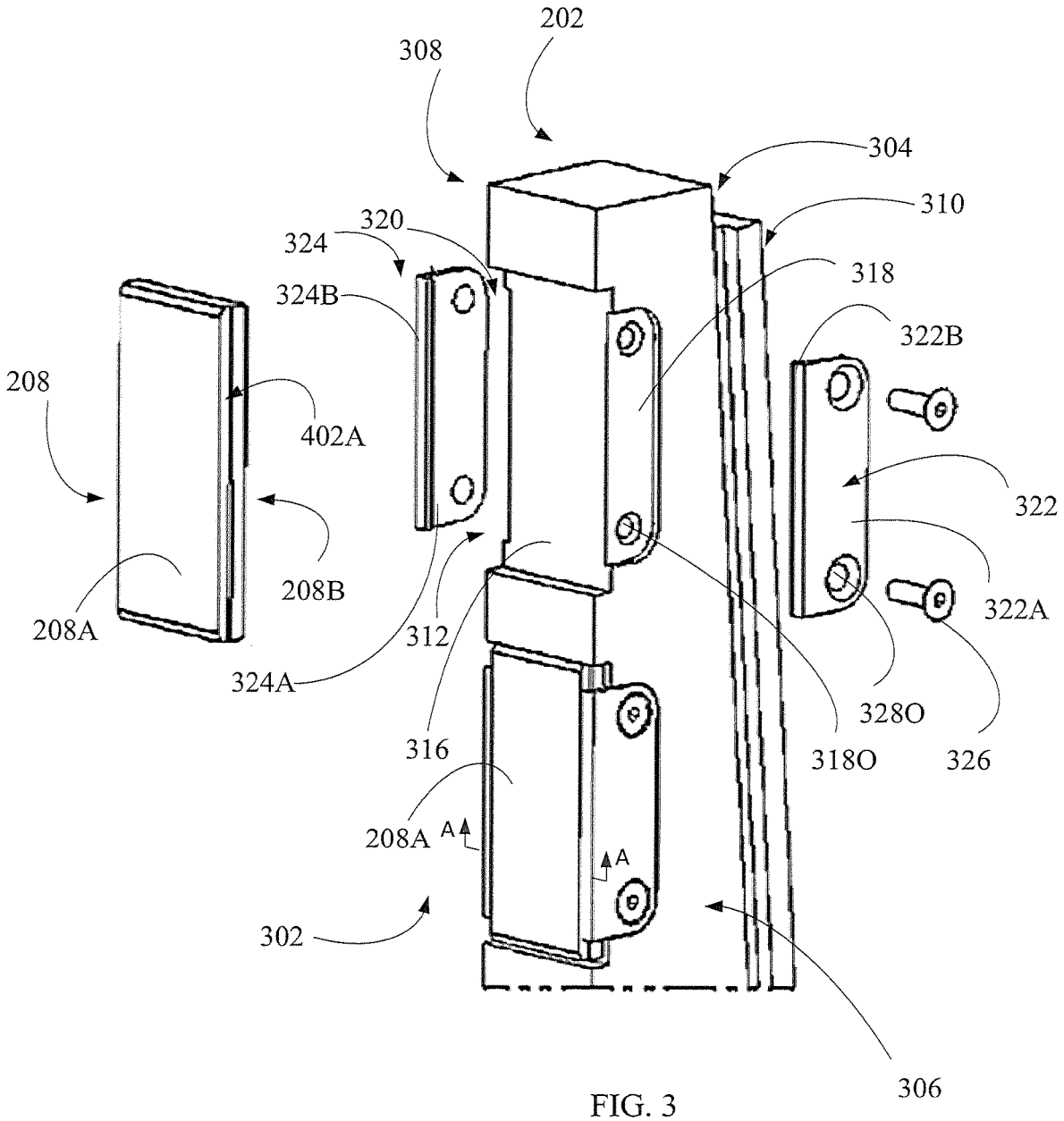
FIG. 3 is a perspective view of a wedge of the elevator braking system of FIG. 2B illustrating the attachment of a brake pad to the wedge.

FIG. 3 shows a portion of the wedge 202 in additional detail. The wedge 202 may have a front face 302, a rear face 304, a first side face 306, and a second side face 308. The front face 302 and the first side face 306 of the wedge 202 may generally oppose the rear face 304 and the second side face 308, respectively. The rear face 304 of the wedge 202 may have secured thereto a wedge bearing race 310, which may allow the wedge 202 to be operably coupled to the inventive roller bearing 204 (see FIGS. 2A-2B) discussed in more detail herein. The front face 302, the first side face 306, and the second side face 308 of the wedge 202 may collectively include one or more brake pad attachment sections 312, and each attachment section 312 may allow for the securement of one brake pad 208 to the wedge 202.

In more detail, the brake pad attachment section 312 may include a recessed brake pad receiving portion 316 formed in the wedge front face 302. The brake pad attachment part 312 may also include a first recessed side plate receiving portion 318 and a second recessed side plate receiving portion 320 that are respectively formed in the first side face 306 and the second side face 308 of the wedge 202. The first recessed side plate receiving portion 318 may oppose the second recessed side plate receiving portion 320 and be generally identical thereto. The first recessed side plate receiving portion 318 and the second recessed side plate receiving portion 320 may each include one or more openings (see, e.g., openings 318O in the first recessed side plate receiving portion 318) to allow for first and second side plates 322 and 324 to be respectively secured via fasteners (e.g., fasteners 326) to the first recessed side plate receiving portion 318 and the second recessed side plate receiving portion 320.

The first side plate 322 may be generally identical to the second side plate 324. The first and the second side plates 322 and 324 may each include one or more openings 328O. When the first side plate 322 is configured within the first recessed side plate receiving portion 318 of the wedge 202, the opening(s) 328O in the first side plate 322 may correspond to the opening(s) 318O in the first recessed side plate receiving portion 318. Similarly, when the second side plate 324 is configured within the second recessed side plate receiving portion 320 of the wedge 202, the opening(s) 328O in the second side plate 324 may correspond to the openings in the second recessed side plate receiving portion 320. The fastener 326 may be passed sequentially through the openings in the side plate and the corresponding opening in the recessed side plate receiving portion (e.g., through the opening 328O in the first side plate 322 and the corresponding opening 318O in the first recessed side plate receiving portion 318) to secure the side plate to the wedge 202.

The first side plate 322 may include a first portion 322A, which may also be referred to herein as the fastener receiving portion 322A. The openings 328O may be provided in the first portion 322A of the first side plate 322. The first side plate 322 may also include a second (or a protruding or overhanging) portion 322B that may extend from the first portion 322A and be generally perpendicular to the first portion 322A. A width of the fastener receiving portion 322A may be greater than a width of the protruding portion 322B. The second side plate 324 may likewise include a first (or a fastener receiving) portion 324A having the fastener receiving openings 328O, and a second (or protruding or overhanging) portion 324B that extends from the first portion 324A and is generally perpendicular thereto.

Figure 4:
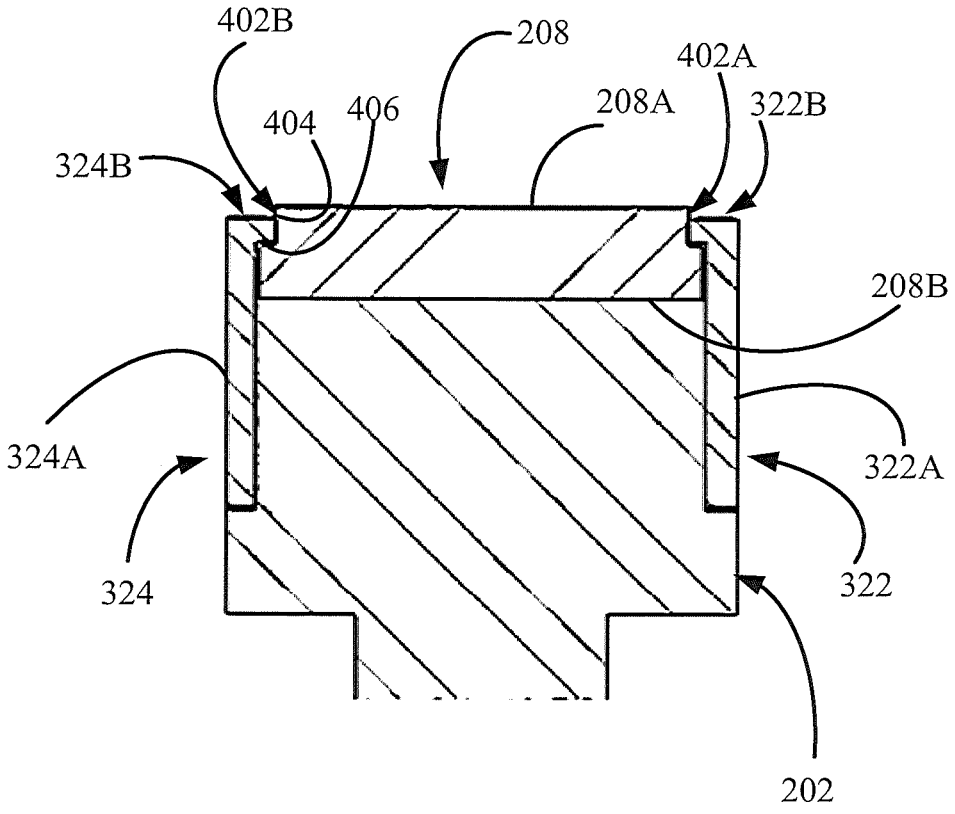
FIG. 4 is a cross section taken along line A-A in FIG. 3.

Focus is directed now to FIG. 4, which shows a cross-sectional view along line A-A in FIG. 3 to illustrate the securement of the brake pad 208 to the wedge 202, and specifically, to the brake pad attachment section 312 (FIG. 3) thereof. The brake pad 208 may be of unitary construction, and in embodiments, may include a front (or braking) face 208A and a back face 208B (see FIGS. 3, 4) that opposes the front face 208A. The brake pad front face 208A may include a notch or groove on either side thereof that extends generally vertically along the front face 208A such that a width of the brake pad back face 208B is greater than a width of the brake pad front face 208A. For example, the brake pad 208 may include a first notch 402A (FIGS. 3, 4) and a second notch 402B (FIG. 4) that each extend generally vertically at opposite sides of the brake pad front face 208A. In embodiments, the notches 402A and 402B may be generally identical and include, for example, a first wall 404 and a second wall 406. The notch first wall 404 may extend from and be generally perpendicular to the braking face 208A. The notch second wall 406 may extend from the notch first wall 404 and be generally perpendicular to the first wall 404. The brake pad notches 402A, 402B, and the side plates overhanging portions 322B, 324B, may collectively allow the brake pad 208 to be operably coupled to the wedge 202 without any fasteners that extend through the brake pad 208.

Specifically, and as can be seen in FIG. 4, when the brake pad 208 is operably coupled to the wedge 202 via the first and the second side plates 322 and 324, the overhanging portions 322B and 324B of the first and second side plates 322, 324 may correspond to and mate with the notches 402A and 402B, respectively. The brake pad 208 may thus be clamped in place in the brake pad receiving portion 316 (see FIG. 3) by the first and second side plates 322 and 324, respectively, and specifically, the overhanging portions 322B and 324B thereof. As can be appreciated from FIG. 4, the dimensions of the first and second notches 402A, 402B of the pad 208 may be configured such that the side plate overhanging portions 322B and 324B are at some distance away from the guiderail when the pad braking face 208A is in contact with the guiderail. That is, the notch first wall 404 (and thus the pad braking face 208A) may extend beyond the side plate overhanging portion (e.g., overhanging portion 322B and 324B) when the overhanging portion clamps the pad 208 to the wedge 202.

In this way, the pad 208 may be operably secured to the wedge 202 without the need for fasteners that extend through (e.g., extend through the braking face of) the brake pad, as in the prior art. Disadvantages of the prior art securing method (e.g., loss in surface area of the pad due to the fasteners that extend through the braking face of the pad, stress concentrations in the pad body that increase the chance of pad cracks, failure, etc.) may therefore be eliminated or at least greatly reduced. Securement of the pad 208 to the wedge 202 in line with the disclosure herein may also allow the shear force on the pad 208 to be more effectively transferred to the wedge 202 as compared to the prior art. Moreover, use of the side clamping plates 322 and 324 (as opposed to fasteners that extend through the pad) may allow maintenance personnel to repair or replace the pad 208 without the need to remove the wedge 202 or the associated roller bearings 204. In a currently preferred embodiment, no adhesive is employed to secure the pads 208 to the wedge 202.

In the prior art, the brake pads (e.g., brake pad 102) may be tightly secured to the wedge (e.g., wedge 104). As such, movement in the brake pad (e.g., where the brake pad increases in size due to thermal expansion during braking operation) may cause undue stress on the brake pad and result in premature wear. In accordance with the present disclosure, the side plates 322 and 324 may be operably coupled to the wedge 202 so as to allow for some play between the brake pad 208 and the wedge 202. Chances of pad failure and/or premature wear of the brake pad due to pad movement (e.g., because of thermal expansion) may therefore be diminished. Further, use of side plates 322 and 324 to secure the pad 208 to the wedge 202 as disclosed herein may allow for use of brake pads (e.g., brake pads 208) whose coefficient of thermal expansion is different from that of the wedge 202. The brake pad 208 may hence be made of any suitable materials, and be, for example, a ceramic matrix composite pad, a carbon metallic pad, a ceramic metallic pad, a sintered pad, a monolithic ceramic pad, a metallic pad, etc.

As noted, the prior art elevator safety gear roller bearings have cylindrical rollers. With such cylindrical rollers, the jaw pivoting motion may be problematic for the friction surface that touches the guiderails as this can cause uneven pressure on the face of the guiderail as well as the face of the friction surface. Such uneven loading may in-turn cause hotspots, uneven wear of friction material, premature failure of friction material, unpredictable braking performance, etc., which may be undesirable. As discussed herein, the rollers of the roller bearing 204 may be barrel shaped, and each of the wedge bearing race 310 and the jaw bearing race 207 in contact therewith may be curved. The barrel shaped rollers of the roller bearing 204 and the curved races may collectively allow the moving race to pivot by small amounts and self-align itself, as needed. Such self-alignment may in turn ensure that the friction face (i.e., the brake pad 208) is in even contact with the guiderail throughout the engagement motion of the wedge 202. In embodiments, the bearing may also accommodate small misalignments of the guiderail to the elevator, thus making the entire system 200 more forgiving and easier to install as compared to prior art safety gear.

Figure 5:
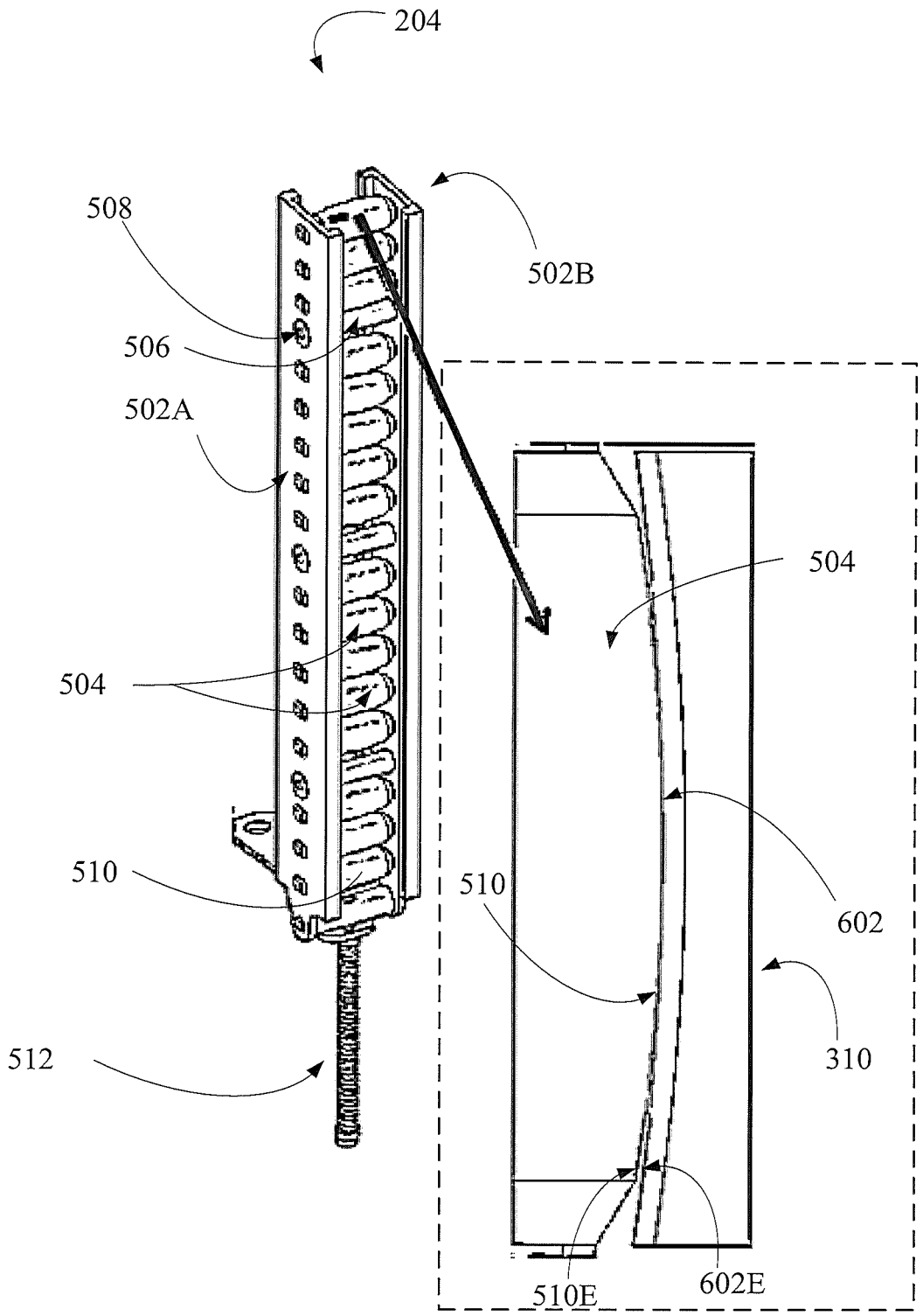
FIG. 5 is a perspective view of a roller bearing of the elevator braking system of FIG. 2B.

Attention is directed to FIG. 5, which shows the example roller bearing 204 (FIG. 2) in more detail. The roller bearing 204 may also be referred to herein as a "roller bearing assembly." The roller bearing assembly 204 may have two opposing cages 502A and 502B. A plurality of rollers 504 may be rotatably coupled to the cages 502A and 502B. The cages 502A and 502B may serve to keep the roller bearing assembly 204 unitized in a compact package.

In some embodiments, the cages 502A, 502B may be coupled to each other with spacers 506 that extend laterally from one cage 502A to the other cage 502B. The spacers 506 may maintain adequate gaps between the rollers 504 and the cages 502A, 502B and ensure that the cages 502A and 502B are properly aligned such that the rollers 504 have sufficient space to freely rotate. The spacer quantity and position may in embodiments be chosen to ensure that the rollers 504 are positioned as desired. In an embodiment, two spacers 506 may be used; in other embodiments, a greater number of spacers 506 may be utilized to ensure proper alignment of the cages 502A, 502B with the rollers 504.

In some embodiments, fasteners 508 may be used to couple the cages 502A, 502B to the spacers 506. The fasteners 508 may comprise screws which are configured to be removable, so as to allow the cage 502A to be conveniently decoupled from the cage 502B to, e.g., replace one or more of the rollers 504. Of course, other type of fasteners 508 (e.g., rivets) may also be employed. In some embodiments, the cages 502A, 502B may be coupled to the spacers by other means, such as via welding, brazing, adhesives, and the like.

The wedge bearing race 310 (see FIG. 3) coupled to the rear face 304 of the wedge 202 may allow the wedge 202 to be operably coupled to a first side 204A (see FIG. 2A) of the roller bearing 204, as shown in FIG. 2B. The clamping jaw bearing race 207 (FIGS. 2A-2B) may allow the clamping jaw 206 to be operably coupled to the second side 204B of the roller bearing. The cages 502A, 502B of the roller bearing 204 may slide up and down along the clamping jaw bearing race 207, as needed. The roller bearing 204 may be conveniently decoupled from the clamping jaw 206 by sliding the cages 502A, 502B all the way down along the clamping jaw bearing race 207.

As noted, rollers used in prior art safety gear systems are cylindrical, and may cause hotspots, uneven wear of brake pads and premature failure thereof, and unpredictable braking performance. To address such concerns, an outer surface 510 (FIG. 5) of each roller 504 of the roller bearing 204 of the elevator braking system 200 may be barrel-shaped (as opposed to being cylindrical), and the races 310 and 207 of the wedge 202 and the clamping jaw 206 may be curved. This configuration may allow the rollers 204 to rock within the races 310 and 207 and self-align properly.

Figure 6:
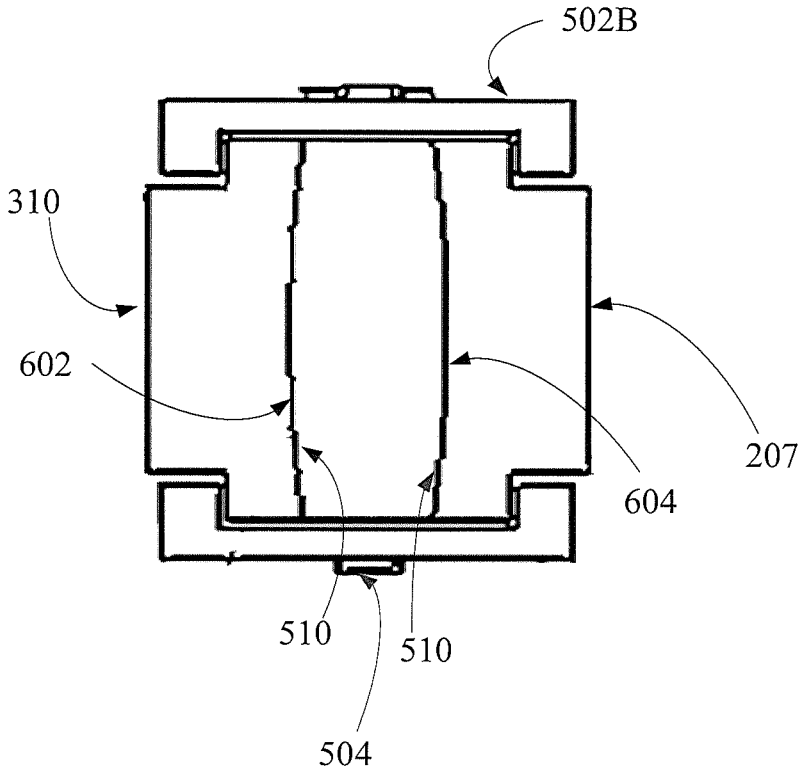
FIG. 6 is a top view of the roller bearing of FIG. 5 operably coupled to a bearing race of the wedge of FIG. 3 and a bearing race of a clamping jaw of FIG. 2.

FIG. 6 shows a top view of the roller bearing 204 coupled to the wedge bearing race 310 at one side and to the clamping jaw bearing race 207 at the other side. As can be seen, the wedge bearing race 310 may have an outer surface 602 that is curved. Specifically, the outer surface 602 of the wedge bearing race 310 may be concave or generally concave. The barrel-shaped outer surface 510 of each roller 504 may be in contact with and largely correspond to the concave outer surface of the wedge bearing race 310. The curved (e.g., concave) outer surface 602 of the wedge bearing race 310 and the curved (e.g., barrel-shaped) outer surface 510 of the roller 504\ may collectively serve to automatically align the wedge 202 to the guiderail during the braking operation. More specifically, the generally corresponding curved surfaces 602 and 510 of the wedge bearing race 310 and the rollers 504, respectively, may allow the wedge bearing race 310 to pivot by small amounts to self-align the wedge 202 to the guiderail when the wedge 202 is moving with respect to the guiderail during a braking operation. This self-alignment during the braking operation may allow the brake pad 208 to contact the guiderail evenly for consistent pressure distribution within the brake pad 208. The curved surface 602 of the wedge bearing race 310 and the curved surface 510 of the roller 504 may thus collectively increase the useful life of the brake pad 208 as compared to brake pads of prior art brake mounting systems. In some embodiments, the bearing race 207 of the clamping jaw 206 may likewise include a curved (e.g., concave) surface 604 that generally corresponds to the curved (e.g., convex) surface 510 of the roller(s) 504.

In a currently preferred embodiment, the curvature of the curved outer surface 510 of the roller 504 may be such that the roller curved outer surface 510 only generally corresponds to—but does not perfectly mate with—the curved outer surfaces 602 and 604 of the wedge bearing race 310 and the clamping jaw race 207. Specifically, in a currently preferred embodiment, the radius of curvature of the roller outer surface 510 may be less than the radius of curvature of the curved races 310 and 207 (see FIG. 5, on the right side). Put differently, and as shown in FIG. 5 on the right side thereof, the curvature of the roller outer surface 510 and the wedge bearing race curved surface 602 may be such that a short distance (e.g., between 1 mm and 2 cm) is maintained between an end 510E of the roller outer surface 510 and a segment 602E of the bearing race curved surface 602 corresponding to the end 510E. A short distance may likewise be maintained between the end 510E of the roller outer surface 510 and the corresponding segment of the clamping jaw bearing race outer surface 604. Applicant's experiments show that such a small discrepancy between the curvatures of the curved outer surface 510 of the roller 504 and the curved outer surface 602 of the wedge bearing race 310 facilitates the self-alignment of the wedge bearing race 310 during the braking operation and results in relatively even brake pad loading. Conversely, where the curvature of the roller outer surface 510 corresponds perfectly with the curvature of the wedge bearing race curved outer surface 602, the brake pads 208 may exhibit uneven loading and/or excessive wear.

In one embodiment, the radius of curvature of the outer surface 510 of each roller 504 may be between 70% and 99%, and more preferably about 75%, of the radius of curvature of the curved races 310 and 207. Such may allow the rollers 504 to rock within the races 310 and 207 and self-align during the braking operation. Further, the relatively smaller radius of curvature of the roller outer surface 510 as compared to the outer surfaces 602 and 604 of the races may afford the rollers 504 room to plastically deform under high compressive loads of the clamping jaw while still allowing for self-alignment.

In some embodiments, and as can be seen in FIG. 5 on the right side, the width of the roller 504 may be less than the width of the race 310 (and the race 207). For example, in an embodiment, the roller face width may be about 80%-85% of the width of the race 310 (and the race 207). This discrepancy in width may allow the roller 504 to shift axially to aid in alignment and preclude the roller face from hanging over the edge of the races 310 and 207. The artisan would appreciate that if the face of the roller 504 were to hang over the edge of the race 310 and/or race 207 during loading, the roller 504 may be damaged and/or excess drag may undesirably result.

In some embodiments, the roller bearing 204 may include a resetting spring 512 (FIG. 5) that extends below the cages 502A and 502B. The resetting spring 512 may hold the roller bearing 204 in its proper position even if the braking system 200 is inverted (or is at another angle from the vertical). The resetting spring 512 may serve to reset the position of the roller bearing 204 along the clamping jaw bearing race 207. Specifically, the downward travel of the roller bearing cages 502A, 502B along the clamping jaw bearing race 207 may cause the spring 512 to eventually contact a stop and contract; the spring 512 may thereafter return to its original shape, and in so doing, return the roller bearing 204 to its initial position.

Figure 7:
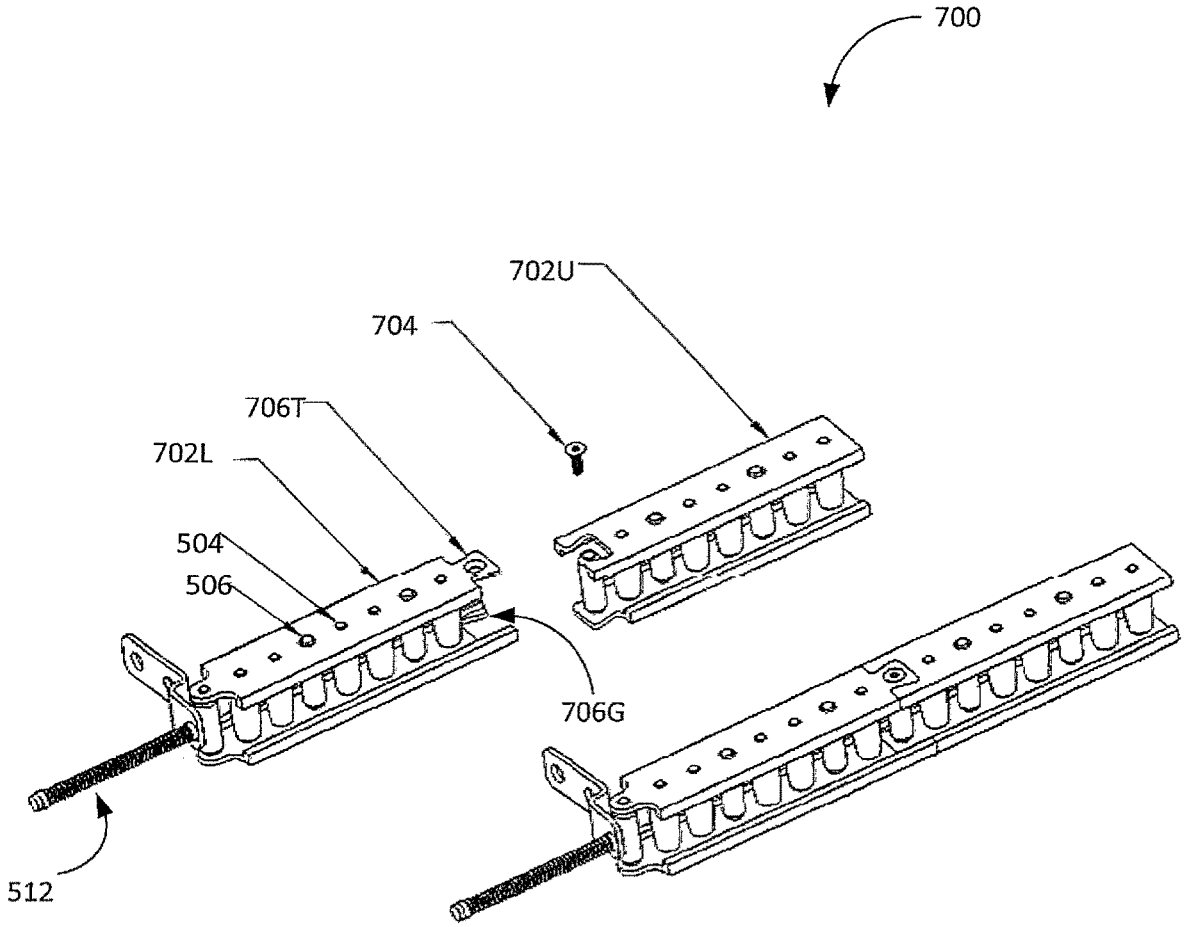
FIG. 7 is a side view of an alternate embodiment of the roller bearing of FIG. 5.

Attention is directed now to FIG. 7, which shows an alternate embodiment 700 of the roller bearing 204. The roller bearing 700 may be similar to the roller bearing 204, except as specifically noted and/or shown, or as would be inherent. Further, those skilled in the art will appreciate that the roller bearing 700 (and the roller bearing 204) may be modified in various ways, such as through incorporating all or part of any of the previously described embodiments, for example. For uniformity and brevity, corresponding reference numbers may be used to indicate corresponding parts, though with any noted deviations. The roller bearing 700 may be usable with other components of the system 200 (e.g., with the wedge 202 and clamping jaw 206 shown in FIGS. 2A-2B).

A key difference between the roller bearing 204 and the roller bearing 700 may be that the roller bearing 700, unlike the roller bearing 204, may be a split (or divisible) bearing. That is, the roller bearing 700 may include an upper portion 702U and a lower portion 702L that are configured to be interlocked to form the roller bearing 700 (FIG. 7 on top left shows the roller bearing upper portion 702U and the roller bearing lower portion 702L before they are coupled together and on the bottom right shows the roller bearing 700 after the upper and lower portions 702U, 702L have been coupled to each other to form the operable bearing 700). Much like the bearing 204, each of the upper portion 702U and the lower portion 702L of the split roller bearing 700 may have two cages that are coupled to each other via fasteners and have spacers 506 therebetween. The lower part 702L may further have a resetting spring 512, as discussed above for the roller bearing 204.

In an embodiment, one cage of the lower portion 702L may have a tab 706T and the other cage of the lower portion 702L may have a groove 706G. In like fashion, one cage of the upper portion 702U may have the tab 706T and the other cage thereof may have the groove 706G. The tab 706T and groove 706G of the lower portion 706T may be configured to mate with the groove 706G and tab 706T of the upper portion 702U, respectively. In embodiments, a fastener 704 (e.g., a screw, a rivet, or other suitable fastener) may be used to couple the lower portion 702L to the upper portion 702U to form the operable bearing 700. In embodiments, the fastener 704 may be removable to allow the upper portion 702U to be conveniently disassociated from the lower portion 702L to split the bearing 700.

The split bearing 700 may in some applications afford one or more advantages over the inventive bearing 204. Because the bearing 204 (and the bearing 700) is fully guided, if the bearing 204 is to be removed, it must be ensured that the entire length of the bearing 204 on either end is clear of obstructions. Conversely, with the split bearing 700, only half the length of the bearing 700 (e.g., only the upper portion 702U or only the lower portion 702L) must be clear of obstructions prior to removal. Such may make servicing the system 200 having the bearing 700 more convenient (as compared to the system 200 having the bearing 204) as less clear space may be required to remove the bearing 700 (as compared to the bearing 204).

Thus, as has been described, the elevator braking system 200, including the roller bearings 204 and/or 700 thereof, may provide numerous benefits over prior art elevator braking systems. For example, the barrel-shaped self-aligning bearings employed in the system 200 may prolong brake pad useful life as compared to prior art systems. The disclosed braking system 200 may further reduce the time and cost associated with maintenance of the braking system components, including of the brake pads 208 thereof.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The disclosure claimed is:

1. An elevator braking system, comprising:

a wedge having a curved wedge bearing race;

a clamping jaw having a curved jaw bearing race; and a roller bearing assembly; said assembly having two cages with a spacer maintaining a space therebetween; a plurality of rollers rotatably coupled to said two cages; each of said plurality of rollers being barrel shaped; a first side of said roller bearing assembly configured to be coupled to said wedge via said curved wedge bearing race; and, a second side of said roller bearing assembly configured to be coupled to said clamping jaw via said curved jaw bearing race;

wherein said roller bearing assembly further comprises a resetting spring; and wherein a radius of curvature of each of said plurality of rollers is less than a radius of curvature of said curved wedge bearing race.

2. An elevator braking system, comprising:

a wedge having a curved wedge bearing race;

a clamping jaw having a curved jaw bearing race; and a roller bearing assembly; said assembly having two cages with a spacer maintaining a space therebetween; a plurality of rollers rotatably coupled to said two cages; each of said plurality of rollers being barrel shaped; a first side of said roller bearing assembly configured to be coupled to said wedge via said curved wedge bearing race; and, a second side of said roller bearing assembly configured to be coupled to said clamping jaw via said curved jaw bearing race;

wherein said roller bearing assembly further comprises a resetting spring; and wherein a radius of curvature of each of said plurality of rollers is less than a radius of curvature of said curved jaw bearing race.

3. An elevator braking system, comprising:

a wedge having a curved wedge bearing race;

a clamping jaw having a curved jaw bearing race; and a roller bearing assembly; said assembly having two cages with a spacer maintaining a space therebetween; a plurality of rollers rotatably coupled to said two cages; each of said plurality of rollers being barrel shaped; a first side of said roller bearing assembly configured to be coupled to said wedge via said curved wedge bearing race; and, a second side of said roller bearing assembly configured to be coupled to said clamping jaw via said curved jaw bearing race;

wherein each of said two cages comprises an upper part and a lower part that is configured to be coupled to said upper part via a fastener.

4. The elevator braking system of claim 3, wherein each said upper part comprises a tab and each said lower part comprises a groove corresponding to said tab.

5. The elevator braking system of claim 3 wherein said wedge comprises a brake pad attachment section, said brake pad attachment section having a recessed brake pad receiving portion and a recessed side plate receiving portion.

6. The elevator braking system of claim 3 wherein a brake pad coupled to said wedge has no apertures extending therethrough.

7. A roller bearing assembly configured to be movably coupled to a wedge of an elevator braking system, comprising:

a first cage;

a second cage;

at least one spacer maintaining a space between said first cage and said second cage;

a plurality of rollers rotatably coupled to said first cage and said second cage; each of said plurality of rollers being barrel shaped; and a resetting spring extending beneath said second cage;

wherein said roller bearing assembly is configured to be movably coupled to a race of said wedge;

wherein said race is curved;

wherein a radius of curvature of each of said plurality of rollers is less than a radius of curvature of said race.

8. A roller bearing assembly configured to be movably coupled to a wedge of an elevator braking system, comprising:

a first cage;

a second cage;

at least one spacer maintaining a space between said first cage and said second cage;

a plurality of rollers rotatably coupled to said first cage and said second cage; each of said plurality of rollers being barrel shaped; and a resetting spring extending beneath said second cage;

wherein said first cage includes a first portion and a second portion removably coupled thereto.

9. The roller bearing assembly of claim 8, wherein said first portion includes a tab and said second portion includes a groove corresponding to said tab.

10. An elevator braking system, comprising:

a wedge having a wedge bearing race;

a clamping jaw having a jaw bearing race; and a roller bearing assembly; said assembly having two cages, each of said two cages being a split cage; said two cages having at least one spacer extending therebetween;

and, a plurality of rollers rotatably coupled to said two cages;

wherein, at least one of said plurality of rollers is barrel shaped.

11. The elevator braking system of claim 10, further comprising a resetting spring.

12. The elevator braking system of claim 10, wherein said wedge bearing race is curved.

13. The elevator braking system of claim 12, wherein a radius of curvature of said at least one barrel shaped roller is less than a radius of curvature of said curved wedge bearing race.

* * * * *